US006619937B2

(12) United States Patent
Friedrichsen et al.

(10) Patent No.: US 6,619,937 B2
(45) Date of Patent: Sep. 16, 2003

(54) HYDRAULIC MACHINE

(75) Inventors: Welm Friedrichsen, Nordborg (DK); Hans-Erik Kiil, Aabenraa (DK); Claus Tjørnly Rasmussen, Nordborg (DK)

(73) Assignee: Sauer-Danfoss Holding A/S, Nordborg (DK)

( * ) Notice: Subject to any disclaimer, the term of this patent is extended or adjusted under 35 U.S.C. 154(b) by 0 days.

(21) Appl. No.: 10/149,829

(22) PCT Filed: Dec. 18, 2000

(86) PCT No.: PCT/DK00/00705

§ 371 (c)(1),
(2), (4) Date: Jun. 12, 2002

(87) PCT Pub. No.: WO01/46560

PCT Pub. Date: Jun. 28, 2001

(65) Prior Publication Data

US 2002/0192095 A1 Dec. 19, 2002

(30) Foreign Application Priority Data

Dec. 20, 1999 (DE) ..... 199 61 401

(51) Int. Cl.[7] ..... F03C 2/00
(52) U.S. Cl. ..... 418/61.3; 418/152; 418/178
(58) Field of Search ..... 418/152, 178, 418/61.3

(56) References Cited

U.S. PATENT DOCUMENTS

| | | | | |
|---|---|---|---|---|
| 2,657,638 A | | 11/1953 | English | |
| 3,246,835 A | * | 4/1966 | Linder | 418/61.3 |
| 3,289,602 A | | 12/1966 | Hudgens | |
| 3,460,481 A | | 8/1969 | White, Jr. | |
| 3,547,563 A | * | 12/1970 | Charlson | 418/61.3 |
| 3,614,274 A | | 10/1971 | Ohrberg et al. | |
| 3,910,733 A | | 10/1975 | Grove | |
| 3,979,167 A | * | 9/1976 | Grove | 418/61.3 |
| 4,008,015 A | * | 2/1977 | McDermott | 418/178 |
| 5,056,994 A | | 10/1991 | Eisenmann et al. | |
| 5,618,171 A | | 4/1997 | von Behr et al. | |

FOREIGN PATENT DOCUMENTS

| | | |
|---|---|---|
| DE | 2333659 A | 1/1975 |
| EP | 0 823 551 A2 | 2/1998 |
| JP | 1147177 A2 | 6/1989 |

* cited by examiner

*Primary Examiner*—Thomas Denion
*Assistant Examiner*—Theresa Trieu

(57) ABSTRACT

The invention concerns a hydraulic machine (1) with a tooth set (2), having a gear wheel (3), which is arranged to be rotating and orbiting in a toothed ring (4), the tooth set (2) being arranged between two plates (10, 11) in the axial direction. It is desired to extend the life of such a machine, also when operated with an impurified hydraulic fluid. For this purpose, at least a section (9') of the circumferential surface of one of the two components, toothed ring (4) and gear wheel (3), is made of a material, which is substantially harder than the material of the part of the other component, gear wheel (3) and toothed ring (4), bearing on this section.

13 Claims, 2 Drawing Sheets

HYDRAULIC MACHINE

FIELD OF THE INVENTION

The invention concerns a hydraulic machine with a tooth set, having a gear wheel, which is arranged to be rotating and orbiting in a toothed ring, the tooth set being arranged between two plates in the axial direction.

BACKGROUND OF THE INVENTION

A machine of this kind is also called a gerotor machine. When supplied with pressurised fluid, it can be operated as a motor. For the purposes of the present invention, this is the main application area. Of course, such a machine can also be operated as a pump, when the gear wheel is driven in relation to the toothed ring.

In such a machine, the gear wheel, which usually has one tooth less than the toothed ring, together with the toothed ring forms a number of pressure pockets or chambers, whose size is reduced or increased when the gear wheel rotates or orbits in relation to the toothed ring. In this connection, the gear wheel bears with its circumferential surface on certain areas of the toothed ring, usually in the area of the teeth. A continuous contact must be ensured to provide a sealing of the individual pressure pockets in relation to each other.

When, however, the hydraulic fluid contains dirt particles, there is a risk that the dirt also penetrates into the tooth set, thus, for example, damaging the rotor. A damage of this kind may occur even through a scratch or a flute, caused by a dirt particle reaching the area where gear wheel and toothed ring bear on each other. The damage in itself involves no big problem. However, there is a risk that a damage of this kind provokes a partial leakage, which again may cause additional damage. This again reduces the life of the machine.

The task of the invention is to extend the life of the machine.

SUMMARY OF THE INVENTION

In a hydraulic machine of the kind mentioned in the introduction, this task is solved in that at least a section of the circumferential surface of one of the two components, toothed ring and gear wheel, is made of a material, which is substantially harder than the material of the part of the other component, gear wheel and toothed ring, bearing on this section.

This embodiment ensures that on the next passing of this very hard spot a damage is evened again. Most frequently, a damage is not caused by a material removal but by a material displacement. On the next passing of the very hard spot, this material displacement can be reversed again. However, also in connection with a material removal the very hard spot is able to even the part provided with the not so hard material to such a degree that the desired smooth surfaces are available. Under certain circumstances, the damaged spot has to pass the hard spot several times. All in all, the tooth set becomes less dirt sensitive and therefore gets a longer life. In this connection it is advantageous to select the hard material so that its stability, its friction coefficient and its coefficient of thermal expansion are at least approximately equal to the corresponding parameters of the remaining material.

Preferably, the toothed ring has teeth, which are formed by rolls, and the section is made up of at least one roll.

This is a very simple way of providing the machine. Toothed rings having rolls as teeth are known per se. When now one of these teeth is made so that it has the desired hardness, the fixing of the hard section on the toothed ring involves no problems. Neither does the transition from the hard section to another section.

Preferably, the roll is made of a ceramic material or has a surface layer of a ceramic material. The ceramic material can be chosen so that it is harder than the material of which the gear wheel is made. Such ceramic materials are known per se.

Preferably, the ceramic material is chosen from the group silicium nitride, carborundum or zirconium dioxide. With such materials, the desired hardness can be produced. Such materials are available as powders. Initially, they can then be pressed to a cylinder shape, then be sintered and smoothed and finally polished. Already the use of one single roll of such a ceramic material will provide the desired extension of the life.

It is also advantageous that the axial length of the rolls is larger than the length of the gear wheel and that the rolls are supported in at least one plate. With this embodiment it is obtained that at least the front sides of the rolls, which project over the gear wheel and thus are supported in the plate, only need to be worked with a reduced accuracy. This leaves only the circumferential working of the rolls, which is required anyway, as the circumference of the rolls is still cooperating with the gear wheel. A sealing between the plate and an inserted roll can at least reach the same quality as a front side sealing.

Usually, it is even possible to reach an improved sealing here. The end face working of the rolls in this spot can almost be completely avoided. It is sufficient to cut off the rolls, for example after working the circumference of the rolls. Most important, however, is the fact that a pairing between the rolls and the gear wheel with regard to their axial lengths can be avoided. Thus, the length tolerances of the rolls are much larger.

Preferably, the rolls are at least supported in the plate, which has commutation openings. This automatically provides an improved allocation between the commutation openings and the individual chambers, which are formed between the toothed ring and the gear wheel. This allocation is obtained and maintained in that the rolls are inserted in the corresponding plate, which can also be called "valve plate".

Preferably, the rolls are supported in both plates. Thus, tilting forces cannot act upon the rolls, which could increase the wear. The bores, in which the rolls are inserted, therefore wear less fast.

Preferably, the rolls are inserted substantially to the same depth in both plates. This gives an improved balance situation, which also contributes to a reduction of the wear.

Advantageously, the rolls are arranged in the plates with an axial play. This ensures that the machine is less sensitive to different thermal expansions of the individual parts. At any rate, the sealing is maintained.

Preferably, the rolls are rotatably supported. The rotatable support of a roll in a bore is possible without problems, without causing much trouble in connection with the sealing. When the rolls rotate, the operating behaviour of the machine is improved.

In a preferred embodiment, at least one plate has oblong commutation openings, which are arranged between the rolls. Due to the bores, which are available for the rolls, less room is available for the commutation openings. However, in order still to provide the desired flow cross section for the hydraulic fluid, the commutation openings are made oblong.

It is also advantageous that the material of the plate, in which the rolls are inserted, is softer than the material of the rolls. This also applies, when the rolls are rotating. The friction between the circumference of the rolls and the cylinder wall of the bore usually causes less wear than the front face wear between the rolls and the plate required until now.

Preferably, the rolls are held in a roll carrier of the toothed ring, whose material has, at least in the area of the rolls, a reduced stability compared to the material of the gear wheel. Until now, the roll carrier has had two functions to perform, namely, firstly to seal the rolls and secondly to serve as slide bearing, that is, to define the position of the rolls in the toothed ring. The latter function is now no longer required, as the rolls are held in the plates. The plates also absorb the forces, which are exerted on the rolls by the gear wheel. Thus, the roll carrier only has to perform the sealing function. However, this is much simpler, as the varying load of the roll carrier is avoided or substantially reduced. This also permits a considerable reduction of the production costs of the toothed ring. A reduced accuracy is required, as the plates secure the exact position of the rolls.

In this connection it is advantageous that the roll carrier has roller-bearing surfaces made of a plastic material. In many cases, a plastic material is better suited for a sealing of the rolls, as it is softer. As stated above, the plastic material only has to be able to absorb forces to a very small degree. In many cases, the working of a plastic material is simpler than the working of a metal surface.

It is also advantageous that the roller-bearing surfaces are made in segments, which are inserted in a roller carrier ring. The roller carrier ring thus gives the toothed ring the stability, which is required to absorb the hydraulic pressures. Accordingly, it is still made of a metal. However, the working of this metal ring can be made with reduced accuracy. The individual segments, which can for example be made of a plastic material, can be worked separately and then inserted in the roll carrier ring. This simplifies the production and keeps the costs low.

In the following the invention is described on the basis of a preferred embodiment in connection with the drawings, showing:

DETAILED DESCRIPTION OF THE PREFERRED EMBODIMENT

Figure 1:
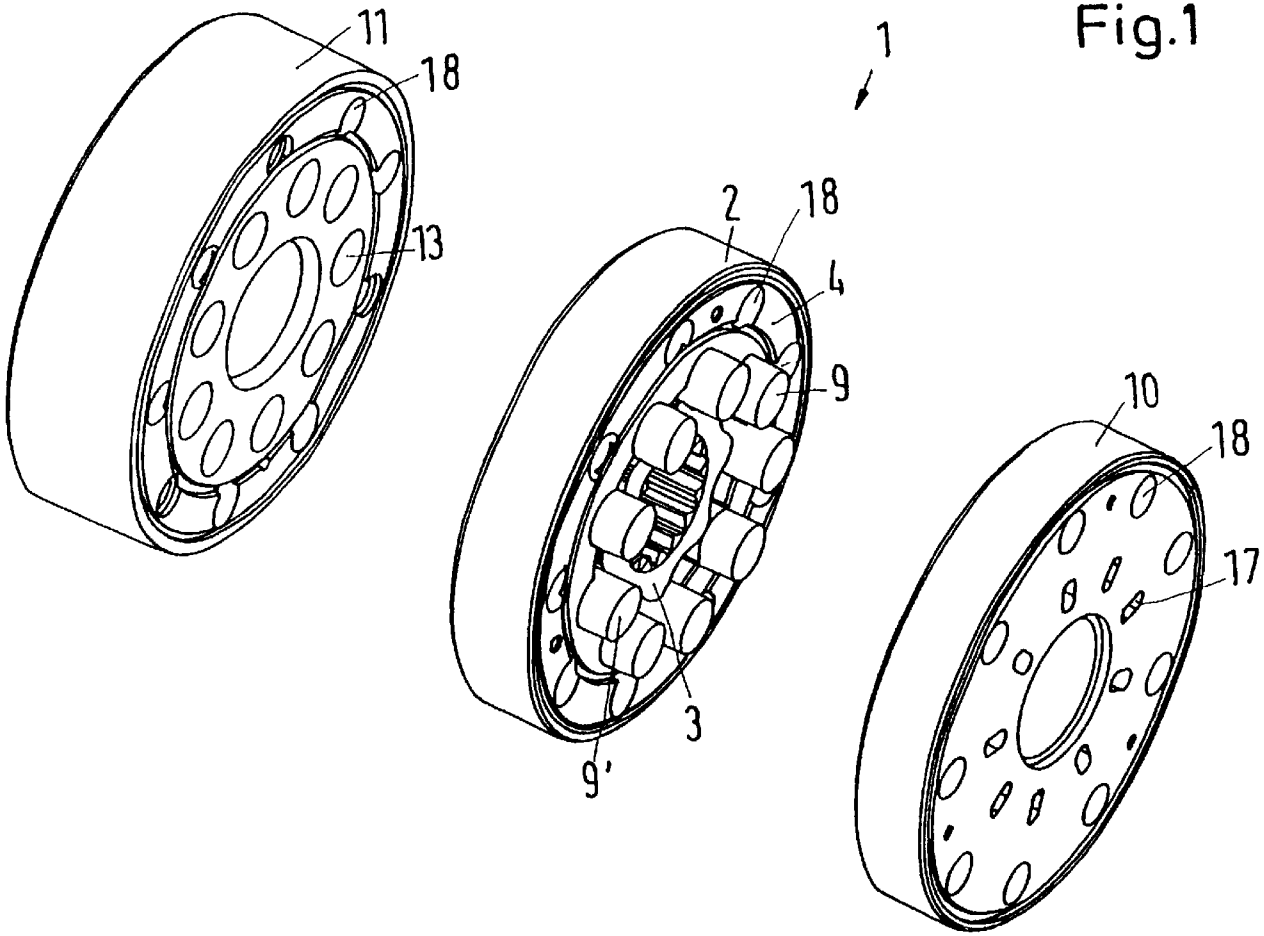
FIG. 1 an exploded view of a hydraulic machine

A hydraulic machine 1, shown in an exploded view in FIG. 1, has a toothed set 2 with a gear wheel 3, which rotates and orbits in a toothed ring 4, that is, the centre 5 of the gear wheel rotates around the centre 6 of the toothed ring. At the same time, the gear wheel 3 rotates around its own centre. This movement causes an extension or a reduction of the size of pressure pockets 7, which are formed between the gear wheel 3 and the toothed ring 4. When the extending pressure pockets are supplied with pressurised fluid, the machine 1 works as a motor. On the inside, the gear wheel has a spline structure 8, in which a cardan shaft or another output part can be inserted. When, however, the gear wheel is driven from the outside, the machine 1 works as a pump. The mode of operation and the basic embodiment of such "gerotor" machines are known per se.

Figure 2:
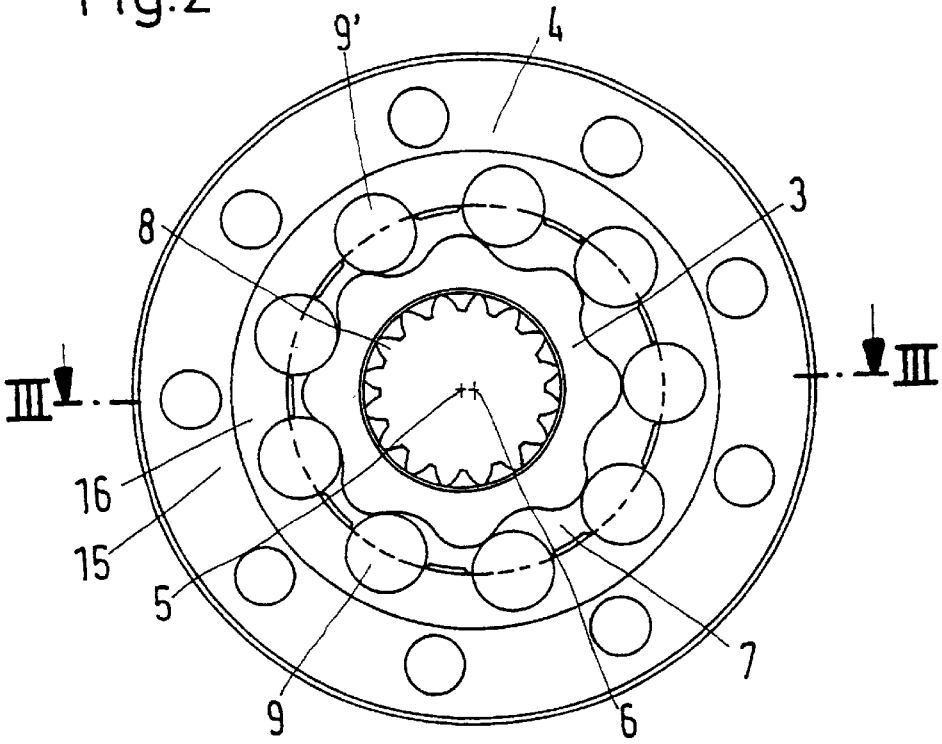
FIG. 2 a front side view

The toothed ring 4 has rolls 9 as teeth. As can be seen from FIG. 2, the gear wheel 3 bears exclusively on the rolls 9 with its outer circumference. Thus, the pressure pockets 7 are limited in the radial and the circumferential directions by the gear wheel 3, the rolls 9 and the remaining inner circumference of the toothed ring 4. The limiting in the axial direction is made by means of two plates 10, 11.

Figure 3:
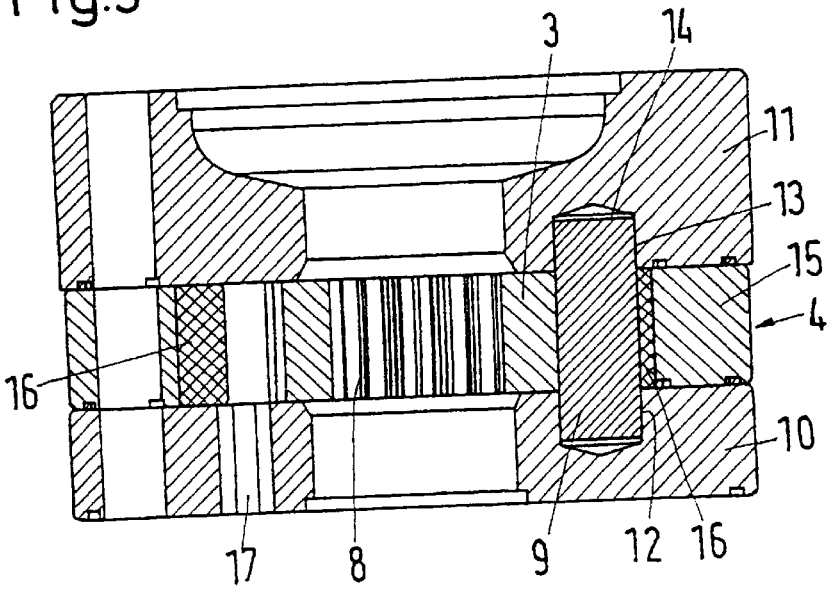
FIG. 3 a section III—III according to FIG. 2

As can be seen from the FIGS. 1 and 3, the gear wheel 3 and the toothed ring 4 have, at least in the area where the two plates 10, 11 are adjacent, the same axial extension or thickness. However, the rolls 9 have a substantially larger axial length, so that they can penetrate into corresponding bores 12, 13 of the plates 10, 11, which could also be called "covers". The rolls 9 penetrate substantially to the same depth in both plates 10, 11. The bores 12, 13 are slightly deeper than required by the axial length of the rolls 9, which leaves a small axial play, so that a change of the length of the rolls 9, for example for thermal reasons, does not necessarily have to occur simultaneously with a change of the thickness of the gear wheel 3 or the tooth set 4.

The rolls 9 can rotate in the bores 12, 13 in the plates 10, 11. Accordingly, a movement of the gear wheel 3 along the rolls 9 substantially only provokes rolling friction.

The sealing between the rolls 9 and the plates 10, 11 no longer occurs on the front sides of the rolls 9, but on their circumferential surface. However, here a sealing is much more easily obtained, even when the rolls are rotating. A front side sealing would require that firstly the front sides are smoothed with a high accuracy and secondly that they extend very accurately in a right angle to the outer cylinder surface of the rolls.

The toothed ring 4 has a roll carrier ring 15, in which plastic segments 16 are inserted. This is possible, because the rolls 9 are held in the plates 10, 11. Thus, the plastic segments 16 no longer have to act as a slide bearing, which positions the rolls 9 in the toothed ring 4. They only have to be able to seal the rolls 9 also during their rotary movement and to stand the hydraulic pressure in the pressure pockets 7. Accordingly, only the roll carrier ring 15 has to have a stability, which is comparable to the stability of the toothed rings used until now. However, it can be made with a much poorer accuracy.

The plate 10 has a number of commutation openings 17, which in a way known per se, but not shown in detail, are supplied with fluid under pressure in dependence of the position of the gear wheel 3 in relation to the toothed ring 4. As the bores 12, 13 have to be available in the plates 10, 11 for the rolls 9, the room left for the commutation openings 17 is rather limited. Therefore, as can be seen from FIG. 1, they are made as oblong openings, so that their flow cross section can be held large enough. This gives an additional advantage in connection with the supporting of the rolls 9 in the plate 10. Via the rolls 9 a unique allocation between the pressure pockets 7 and the commutation openings 17 is realised, so that the risk of wrong commutations and the resulting wear can be kept small.

The material of the plates 10, 11 can therefore also be chosen to be somewhat softer than the material of the rolls 9. The wear in connection with a rotary movement of the rolls 9 in the plates 10, 11 is substantially smaller than a front side friction.

One of the rolls 9' is made as a ceramic roll or at least has a surface layer of a ceramic material. Thus, the material of this roll 9' is substantially harder than the material of the gear wheel 3. If, because of an impurification of the hydraulic fluid small damages should occur on the surface of the gear wheel 3, these can be smoothened again on the next rotation by the ceramic roll 9'. Thus, the ceramic roll 9' smoothens the circumferential surface of the gear wheel again. Of course, all rolls 9 can also be made of the ceramic material or have a surface layer of a ceramic material. However, normally this is not necessary.

The ceramic material could, for example, be silicium nitride, carborundum or zirconium dioxide. Such materials are available as powders, so that they can be pressed into the desired shape, then sintered, smoothened and finally polished. As also the ceramic roll 9' is supported in a plastic segment 16, no large risks exist with regard to the friction between moving parts.

In a way known per se, bores 18 are provided in the toothed ring 4 and in the two plates 10, 11, through which the bolts, not shown in detail can be inserted to connect the tooth set 2 with the two plates 10, 11.

Deviations from the embodiment shown can take place in many ways. Particularly, the toothed ring 4, apart from the rolls 9, can be made in one piece. All rolls 9 can be made of metal, and in return a corresponding circumferential section of the gear wheel 3, preferably a tooth, can be covered with a ceramic layer, or the whole gear wheel 3 can be made of a ceramic material. In this case, damages to the rolls 9 can be smoothened.

What is claimed is:

1. A hydraulic machine with a tooth set, having a gear wheel, which is arranged to be rotating and orbiting in a toothed ring, the tooth set being arranged between two plates in an axial direction; at least a section of a circumferential surface of one of the two plates, a toothed ring (4) and a gear wheel (3), being made of a material which is substantially harder than the material of the part of the other plate, gear wheel and toothed ring, bearing on the section, characterised in that the toothed ring (4) has teeth which are formed by rolls (9, 9'), and the section is made up of at least one roll (9') that is made of a ceramic material or has a surface layer of a ceramic material, which is harder than the material of which the gear wheel (3) is made.

2. A machine according to claim 1, characterised in that the ceramic material is chosen from the group silicium nitride, carborundum or zirconium dioxide.

3. A machine according to claim 1, characterised in that the axial length of the rolls (9, 9') is larger than the length of the gear wheel (3) and that the rolls (9, 9') are supported in at least one plate (10, 11).

4. A machine according to claim 3, characterised in that the rolls (9, 9') are at least supported in the plate (10), which has commutation openings (17).

5. A machine according to claim 3, characterised in that the rolls (9, 9') are supported in both plates (10, 11).

6. A machine according to claim 5, characterised in that the rolls (9, 9') are inserted substantially to the same depth in both plates (10, 11).

7. A machine according to claim 3, characterised in that the rolls (9, 9') are arranged in the plates (10, 11) with an axial play (14).

8. A machine according to claim 3, characterised in that the rolls (9, 9') are rotatably supported.

9. A machine according to claim 3, characterised in that at least one plate (10) has oblong commutation openings (17), which are arranged between the rolls (9).

10. A machine according to claim 3, characterised in that the material of the plate (10, 11), in which the rolls (9, 9') are inserted, is softer than the material of the rolls (9, 9').

11. A machine according to claim 3, characterised in that the rolls (9, 9') are held in a roll carrier (15, 16) of the toothed ring (4), whose material has, at least in the area of the rolls (9, 9'), a reduced stability compared to the material of the gear wheel (3).

12. A machine according to claim 11, characterised in that the roll carrier (15, 16) has roller-bearing surfaces made of a plastic material.

13. A machine according to claim 11, characterised in that the roller-bearing surfaces are made in segments (16), which are inserted in a roller carrier ring (15).

* * * * *